US006892511B2

(12) United States Patent
Wagner

(10) Patent No.: US 6,892,511 B2
(45) Date of Patent: May 17, 2005

(54) WRAPPING APPARATUS

(76) Inventor: Paul F. Wagner, 8935 San Patricio Ct., Houston, TX (US) 77064

( * ) Notice: Subject to any disclaimer, the term of this patent is extended or adjusted under 35 U.S.C. 154(b) by 0 days.

(21) Appl. No.: 10/385,395

(22) Filed: Mar. 10, 2003

(65) Prior Publication Data

US 2004/0016217 A1 Jan. 29, 2004

Related U.S. Application Data

(60) Provisional application No. 60/362,758, filed on Mar. 8, 2002.

(51) Int. Cl.[7] ..... B65B 67/10

(52) U.S. Cl. ..... 53/390; 53/219

(58) Field of Search ..... 53/218, 219, 390, 53/228, 138.6, 138.7, 465, 461

(56) References Cited

U.S. PATENT DOCUMENTS

| | | | | | |
|---|---|---|---|---|---|
| 200,342 | A | * | 2/1878 | Relph | 53/138.7 |
| 813,832 | A | * | 2/1906 | Rudd | 53/138.7 |
| 892,185 | A | * | 6/1908 | Rudd | 53/138.7 |
| 2,641,304 | A | * | 6/1953 | Biddinger et al. | 53/219 |
| 2,885,839 | A | * | 5/1959 | Weiss | 53/399 |
| 2,894,363 | A | * | 7/1959 | Voogd | 53/228 |
| 3,546,836 | A | * | 12/1970 | Buob et al. | 53/390 |
| 3,579,962 | A | * | 5/1971 | Mitten | 53/390 |
| 3,747,293 | A | * | 7/1973 | Van Slooten et al. | 53/439 |
| 3,792,565 | A | * | 2/1974 | Goransson | 53/390 |
| 4,257,212 | A | * | 3/1981 | Havens | 53/219 |
| 4,388,796 | A | * | 6/1983 | Zelnick | 53/218 |
| 4,680,918 | A | * | 7/1987 | Lovell | 53/219 |
| 5,249,407 | A | * | 10/1993 | Stuck | 53/399 |
| 5,544,468 | A | * | 8/1996 | Harrison et al. | 53/390 |

* cited by examiner

*Primary Examiner*—John Sipos
(74) *Attorney, Agent, or Firm*—Locke Liddell & Sapp LLP

(57) ABSTRACT

An apparatus for wrapping an item, e.g., a gift basket is disclosed. Also disclosed is a method for wrapping an item, e.g., a gift basket, using the apparatus.

6 Claims, 5 Drawing Sheets

WRAPPING APPARATUS

CROSS-REFERENCE TO RELATED APPLICATIONS

This application claims priority to U.S. Provisional Patent Application Ser. No. 60/362,758, filed on Mar. 8, 2002, and having the same title and inventor as the present application.

TECHNICAL FIELD

This invention relates to apparatus and methods for wrapping items, and more particularly to a device for wrapping gift baskets and the like.

BACKGROUND OF THE INVENTION

Gift baskets and similar items have enjoyed increasing popularity. In preparing such items, it is desirable to wrap the item. Many items are typically wrapped in wrapping material secured with a string, bow or other ribbon like material so as to provide a plume of wrapping material at the top of the item. These plumes have typically been time-consuming and difficult to make. An additional problem has been keeping the item to be wrapped centered within the wrapping material to provide a symmetric and aesthetically pleasing plume. What is needed in the art is an apparatus for assisting in the wrapping of gift baskets and similar items that simplifies wrapping of the item and allows for easier and quicker wrapping.

SUMMARY OF THE INVENTION

The present invention is directed to an apparatus for assisting in the wrapping of items such as gift baskets. An apparatus in accordance with the present invention includes a bottom support and one or more members elastically supporting clamps for securing the wrapping material. The item to be wrapped is placed in the wrapping material and is self-centered by operation of the apparatus. The wrapping material may then be secured with a string, ribbon, bow or other string-like material to form an aesthetically pleasing plume on the wrapped item.

DETAILED DESCRIPTION OF THE INVENTION

Figure 1:
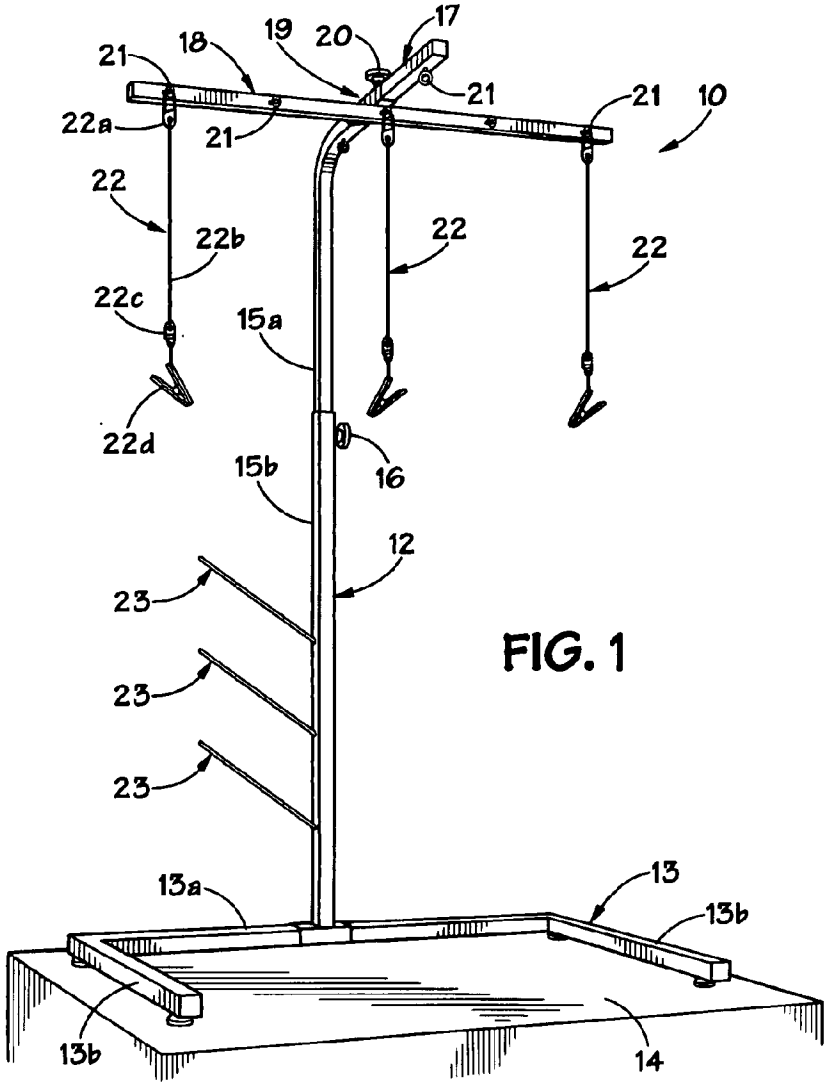
FIG. 1 is an illustration of a wrapping apparatus in accordance with the present invention.

Turning to the drawings and, in particular, to FIG. 1 a first embodiment of an apparatus 10 for assisting in the wrapping of an item, such as a gift basket is illustrated.

In the illustrated embodiment, apparatus 10 comprises a boom assembly 12 formed from tubular metal. Alternate embodiments are envisioned where the boom assembly 12 is formed from other materials such as plastic, rubber or wood.

The boom assembly 12 has a base 13 that supports the apparatus 10 on a flat surface, such as a table. In the illustrated embodiment, the base 13 comprises a back section 13*a* and two front extending sections 13*b*. The sections of the base 13 are configured such that the base defines an open area 14.

Extending upwardly from the base 13 of the boom assembly 12 is an upright section 15 that is formed from two nested sections, 15*a* and 15*b*. A screw element 16 is used to provide pressure to maintain section 15*a* in a fixed relationship to section 15*b*. The length of the upright section 15 can be adjusted by unscrewing the screw element 16, sliding the section 15a upward or downward as desired and retightening the screw element 16. Adjustment of the length of upright section 15 is particularly beneficial in adjusting the apparatus for wrapping items of different sizes.

A forward section 17 extends forwardly from upright section 15. In the illustrated embodiment, forward section 17 is formed from the same tubular member as section 15*a* through a bend in the element.

A square frame member 19 that fits around forward section 17 couples a horizontal member 18 to forward section 17. A screw member 20 passes through the frame member 19 and holds the horizontal member 18 in a fixed location with respect to section 17. In the illustrated embodiment, the screw member 20 may be loosened to allow adjustment of the position of the horizontal member 18 along element 17.

While the embodiment of FIG. 1 illustrates the use of screw members 16 and 20 to provide for adjustability of the height of boom member 12 and the location of horizontal member 18, alternate adjustment structures such as clamps, spring biased interfitting members, notches/holes and retaining pins, etc. may be used to provide the desired adjustability.

Multiple eyelets 21 are attached to horizontal member 18. An eyelet 21 is also attached to forward section 17. As described below, the eyelets 21 define points for coupling wrap-retaining members to the boom assembly 12. Alternate embodiments are envisioned where structures other than eyelets, for example hooks, projections or holes in horizontal member 18 provide the structure for coupling the wrap retaining members to the horizontal section 18.

In the embodiment of FIG. 1, three wrap retaining members 22 are coupled to, and extend from, three of the eyelets 21. Each of the wrap retaining members comprises a first clip 22*a* that couples the wrap retaining member to an eyelet, an elastic cord section 22*b*, and a second clip 22*c* that is coupled to a clamp 22*d*. As described in more detail below, the wrap retaining members are used to retain wrap material in a desired position during the wrapping of an item, such as a gift basket.

The elastic cord section 22*b* may be formed from any elastic material such as a bungee cord. The degree of elasticity of the elastic cord section should be selected to provide relatively free movement of the cord during use of apparatus 10.

Clamp 22*d* may be any clamp suitable for holding wrap material. Depending on the type of wrap material to be used with apparatus 10, it may be desirable for clamp 22*d* to be a rubber or plastic coated clamp, as such clamps have been found to provide adequate grip for most wrap materials. In general, clamp 22*d* should have relatively smooth clamp surfaces, so as to not puncture the wrap material or create undesirable indentations or impressions in the wrap material to be used with apparatus 10.

Figure 2:
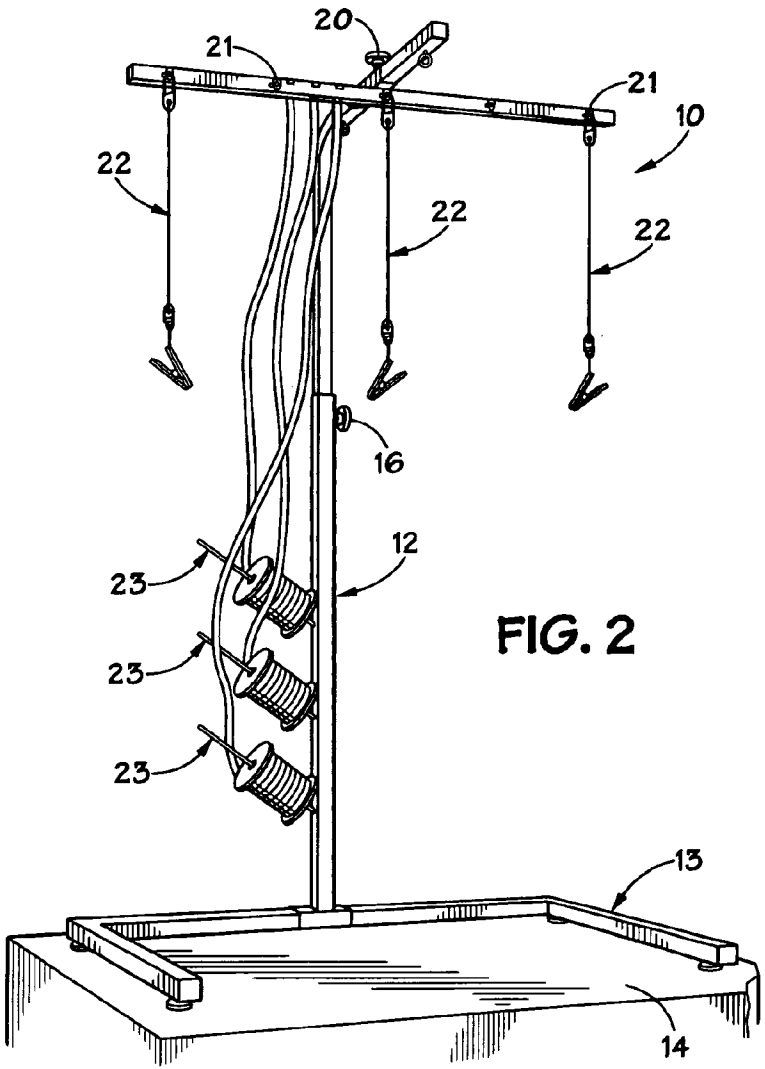
FIG. 2 is an illustration of a wrapping apparatus in accordance with the present invention illustrating the configuration of ribbon spools for use in the wrapping operation.

In the illustrated embodiment of FIG. 1, ribbon-holding elements 23 extend from the upright section 15 of the boom assembly 12. The ribbon holding elements 23 are in the form of rods that project from section 15. As illustrated more clearly in FIG. 2, the ribbon holding sections may provide support for ribbon spool. A spring element stretches across all or a portion of horizontal member 18 and can retain the loose end of the ribbon spool.

The apparatus 10, described above, may be used to implement a beneficial method for wrapping an item, such as a gift basket. The unique method enabled by apparatus 10 will be described in connection with FIGS. 3–7.

Figure 3:
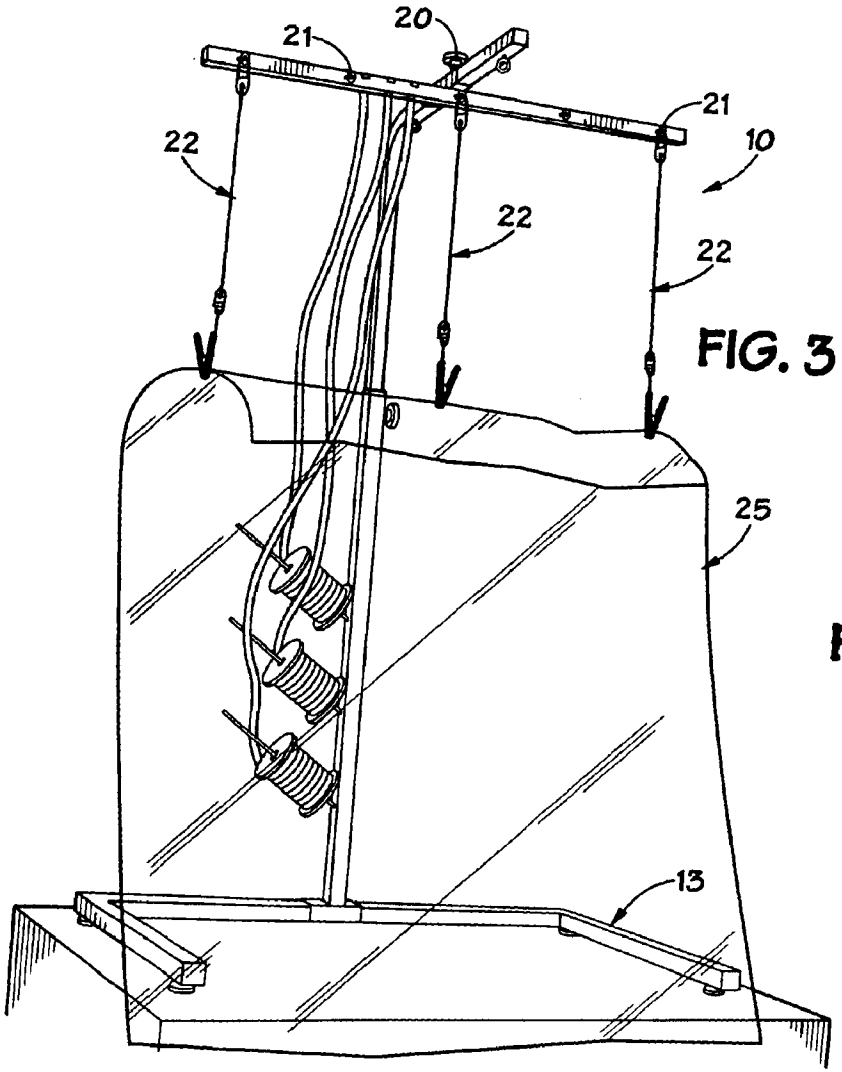
FIG. 3 illustrates a wrapping apparatus in accordance with the present invention with a sheet of wrapping material held in an initial position for wrapping an item.

Referring to FIG. 3, a first step in the method under discussion involves the placement of one end of a sheet of wrapping material 25 into one or more of the clips of the wrap retaining members 22. Before placing the end of the wrapping material into the clips of the wrap retaining members 22, the location of the members 22 may be adjusted to provide for a desired "plume" or wrap effect. In the illustrated example, this adjustment may be made by simply adjusting the positions of the member 22 by clipping the members to alternate eyelets 21. Alternate embodiments are envisioned where the clips 22 may be infinitely adjustable along the horizontal member 18 and/or the forward section 17. As will be apparent from the following discussion, the positioning of wrap retaining members 22 may have an impact on the visible appearance of the plume created when the wrapping of the item to be wrapped is completed.

Figure 4A:
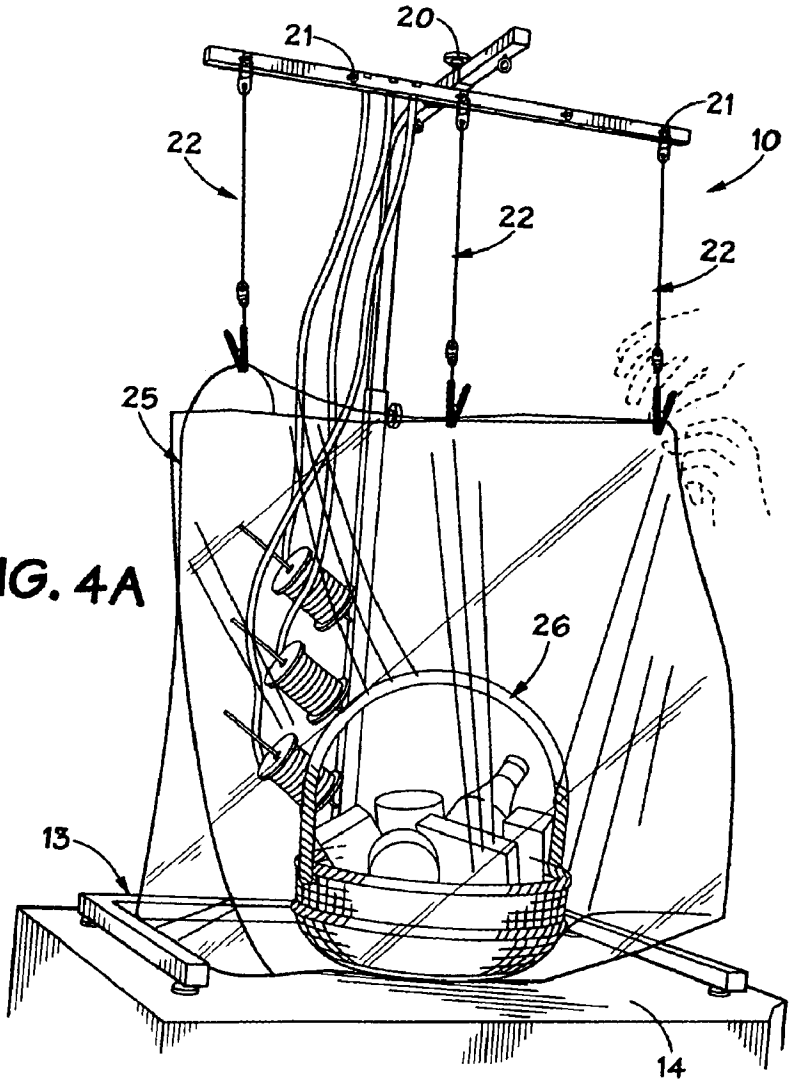
FIG. 4*a* illustrates a wrapping apparatus in accordance with the present invention with the item to be wrapped disposed within the wrapping material.
Figure 4B:
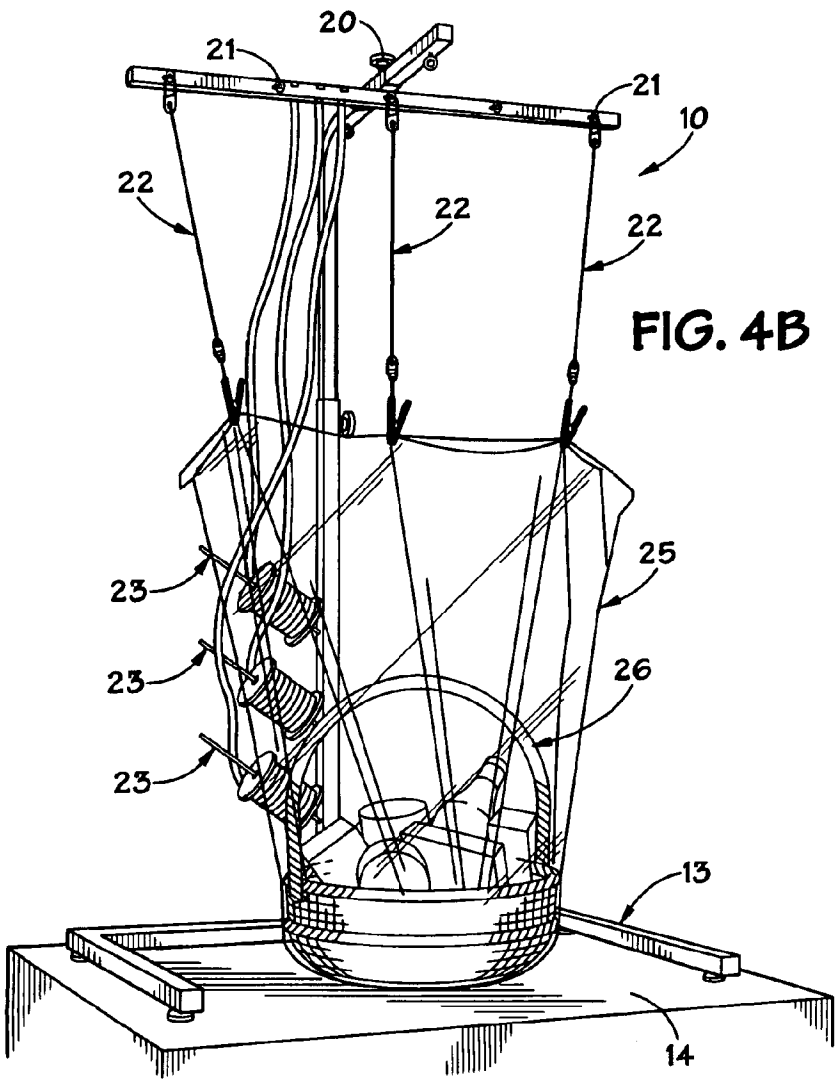
FIG. 4*b* further illustrates a wrapping apparatus in accordance with the present invention with the item to be wrapped self-centered within the wrapping material.

Once an end of the sheet material is positioned within one or more clips of wrap retaining members 22, the item to be wrapped may be placed on top of the wrap material 25. The end of the wrap material 25 that is not held by the wrap retaining members 22 may then be lifted up and over the item to be wrapped and placed within one or more of the clips of the wrap retaining members 22 such that the wrap will surround the item. This method step is illustrated in FIGS. 4A and 4B where a gift basket 26 is shown positioned within wrap material. It should noted that the use of assembly 10 allows the item 10 to be wrapped to be automatically centered within the wrap material 25. This "self centering" feature of assembly 10 is of particular significance as centering of the item to be wrapped within material 25 is believed to provide the most visibly attractive plume. Additionally, flexibility in creating the plume is provided by the "bungee" effect of elastic cord sections 22*b*.

Figure 5:
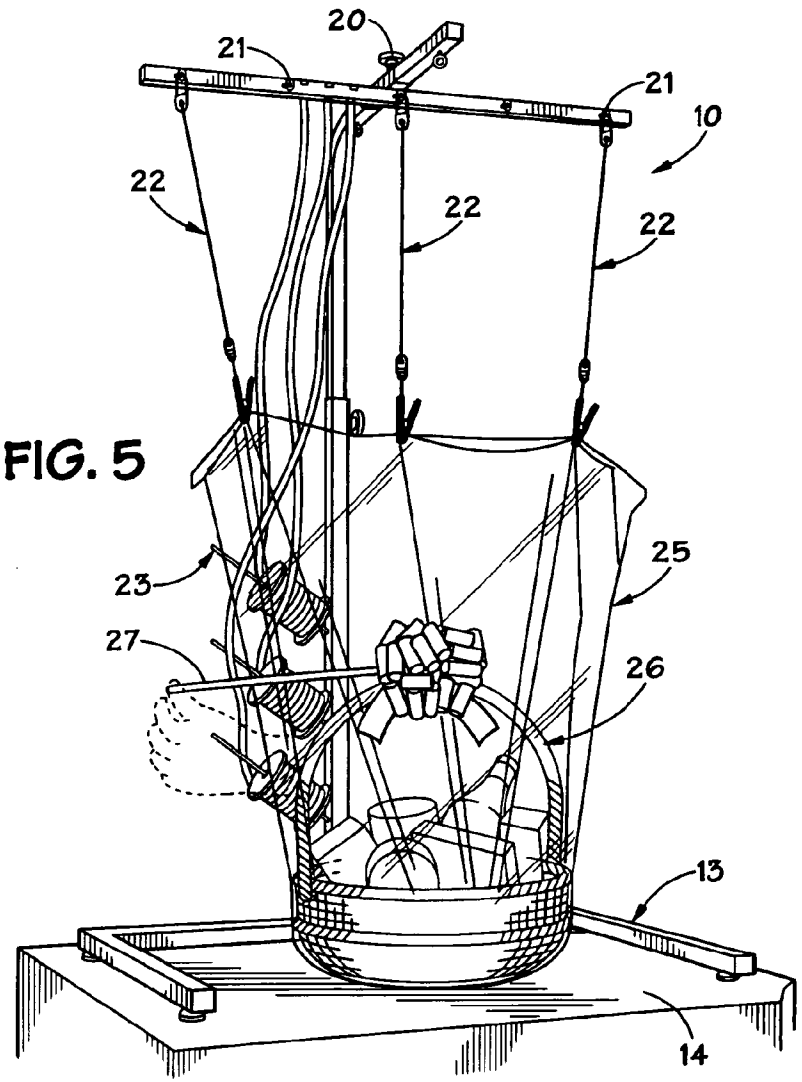
FIG. 5 illustrates a wrapping apparatus in accordance with the present invention with a string or ribbon-like member disposed around the wrapping material to complete wrapping of the item.

Once the wrap material 25 is positioned within wrap retaining members a ribbon, rope or other string-like element may be positioned around a portion of the wrap material 25 so as to complete the wrapping of the item to be wrapped. This method step is illustrated in FIG. 5 where "Big John" is illustrated placing a ribbon 27 about a section of wrap material 25 that extends above the handle of basket 26. It should be noted that because the wrap retaining members 22 hold the wrap material 25 in place without the need for additional support, the use of assembly 10 allows the user of the assembly to use both hands when placing the ribbon or other string-like material about the basket.

Figure 6:
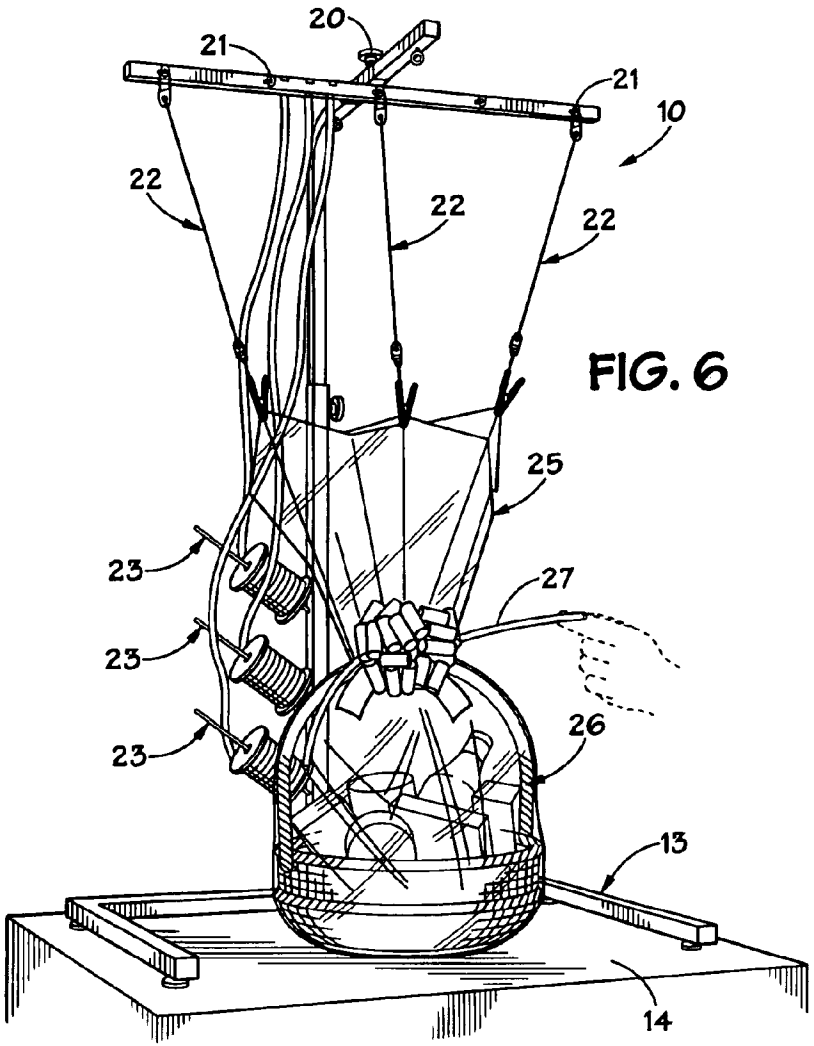
FIG. 6 further illustrates a wrapping apparatus in accordance with the present invention with a string or ribbon-like member disposed around the wrapping material to complete wrapping of the item.

During a subsequent method step, the ribbon or other string-like material 27 may be pulled taut to complete the wrapping of item 28. This method step is illustrated in FIG. 6. Again, the use of assembly 10 allows the operator of the assembly to use both hands when pulling taut element 27. It should be noted that when the ribbon or other string-like material 27 is positioned around the wrap 25 and pulled taut the elastic cord sections 22*b* of the wrap retaining members will typically stretch.

Figure 7:
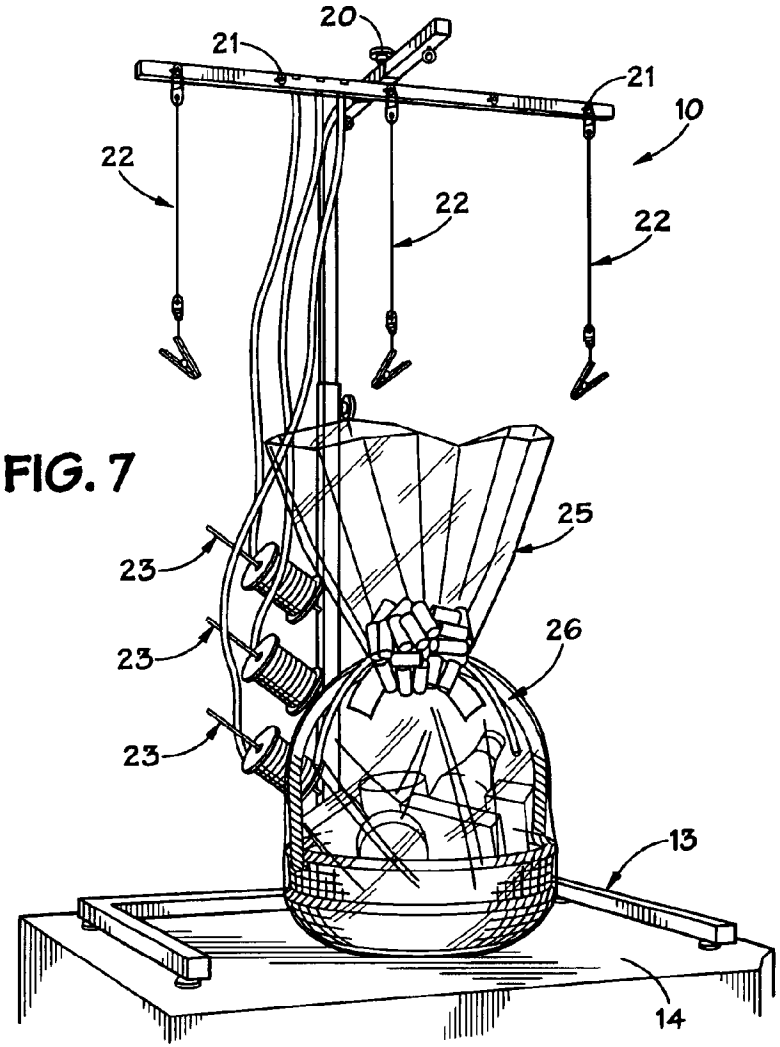
FIG. 7 illustrates an item completely wrapped in accordance with the present invention.

Once the ribbon or other material 27 is pulled taut, the wrapping of the item is completed and the clamps of wrap retaining members 22 may be opened to release the wrapped item as illustrated in FIG. 7.

Figure 8:
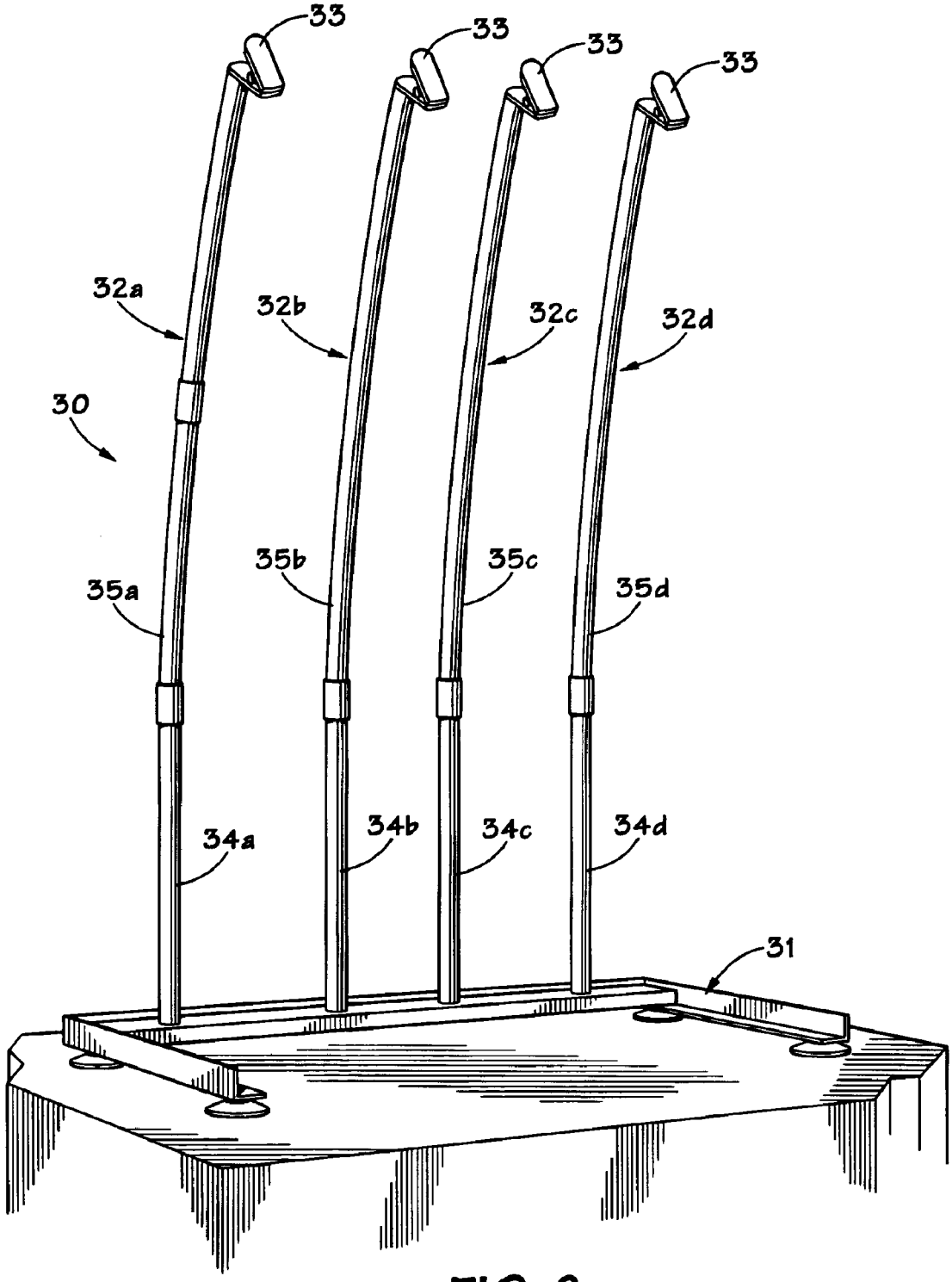
FIG. 8 illustrates an alternative embodiment of a wrapping apparatus in accordance with the present invention.

An alternate embodiment of the apparatus 10 for assisting in the wrapping of an item is generally illustrated in FIG. 8.

Referring to FIG. 8, a wrap assembly 30 is provided that includes a base element 31 and four upwardly extending elements 32*a*–32*d*. Each of the upwardly extending elements 32*d* is formed of two segments, a rigid lower segment 35*d* (formed from a rigid or semi-rigid material such a plastic or suitable metal) and a flexible upper segment 35*d* (formed from a material such as plastic or rubber) such that the element can bend and "bow." The upwardly extending elements may be of fixed length or some mechanism (such as telescoping interfitting members) may be used to allow for length adjustment of the members.

Coupled to the upper end of flexible members 32*a*–32*d* are clamps 33. The clamps 33 should be selected using the same criteria described above in connection with clamps 22*d*.

During operation, the structure 30 of FIG. 8 allows for the wrapping of an item using a method substantially similar to that described above in connection with apparatus 10. Specifically, one end of a sheet of wrap material may be placed within clamps 33. The item to be wrapped may be placed on top of the sheet of wrap material and the free end of the sheet may be lifted and placed within clamps 33 to "self center" the item within the wrap material. During operation, the flexible members 32*a*–32*d* will bend, proving a degree of elasticity.

Once the item to be wrapped is positioned within the sheet of wrapping material, a ribbon or other string-like material may be placed about the material and the wrapping of the item may be completed substantially as described above.

Though the present invention has been described with reference to two exemplary embodiments, other embodiments and modifications will be readily apparent to one of ordinary skill in the art having benefit of the present disclosure. It is intended that the scope of the invention be limited only by the scope of the appended claims.

What is claimed is:

1. An apparatus for wrapping an item comprising:

a horizontal base;

a vertical support member attached to the horizontal base and extending upwardly from the horizontal base;

a horizontal member attached to the vertical support member opposite said horizontal base;

a plurality of clamps supported by the horizontal member arranged to secure wrapping material;

one or more ribbon holding elements connected to the vertical support member; and a retaining member attached to the horizontal member to receive ribbon from the ribbon holding elements.

2. The apparatus of claim 1 wherein the vertical support member is adjustable in height.

3. The apparatus of claim 2 wherein the vertical support member comprises a plurality of telescoping sections, whereby height adjustment of the vertical support member is effectuated.

4. The apparatus of claim 1 wherein the clamps are secured to the horizontal member by an elastic cord.

5. The apparatus of claim 1 wherein the placement of the horizontal member relative to the vertical support member is adjustable.

6. The apparatus of claim 1 wherein the clamps are coated with rubber or plastic.

* * * * *